United States Patent [19]

Fink et al.

[11] 4,232,244

[45] Nov. 4, 1980

[54] COMPACT, MAINTAINABLE 80-KEV NEUTRAL BEAM MODULE

[75] Inventors: Joel H. Fink; Arthur W. Molvik, both of Livermore, Calif.

[73] Assignee: The United States of America as represented by the United States Department of Energy, Washington, D.C.

[21] Appl. No.: 954,679

[22] Filed: Oct. 25, 1978

[51] Int. Cl.[3] ..... H05H 1/00

[52] U.S. Cl. ..... 313/363; 313/230

[58] Field of Search ..... 313/359, 362, 230, 363; 315/111.8

[56] References Cited

U.S. PATENT DOCUMENTS

| | | | |
|---|---|---|---|
| 2,856,532 | 10/1958 | Martina | 313/230 X |
| 3,660,715 | 5/1972 | Post | 313/230 X |
| 3,760,225 | 9/1973 | Ehlers et al. | 313/363 X |
| 3,846,668 | 11/1974 | Ehlers et al. | 313/230 X |

*Primary Examiner*—Robert Segal

*Attorney, Agent, or Firm*—James E. Denny; Roger S. Gaither; L. E. Carnahan

[57] ABSTRACT

A compact, maintainable 80-keV arc chamber, extractor module for a neutral beam system immersed in a vacuum of $<10^{-2}$ Torr, incorporating a nested 60-keV gradient shield located midway between the high voltage ion source and surrounding grounded frame. The shield reduces breakdown or arcing path length without increasing the voltage gradient, tends to keep electric fields normal to conducting surfaces rather than skewed and reduces the peak electric field around irregularities on the 80-keV electrodes. The arc chamber or ion source is mounted separately from the extractor or ion accelerator to reduce misalignment of the accelerator and to permit separate maintenance to be performed on these systems. The separate mounting of the ion source provides for maintaining same without removing the ion accelerator.

9 Claims, 3 Drawing Figures

COMPACT, MAINTAINABLE 80-KEV NEUTRAL BEAM MODULE

BACKGROUND OF THE INVENTION

The invention described herein was made at the Lawrence Livermore Laboratory in the course of, or under, Contract No. W-7405-ENG-48 between the U.S. Department of Energy and the University of California.

The invention relates to neutral-beam systems and more particularly a compact 80-keV arc-chamber-extractor module for a neutral beam module.

Plasma sources for neutral-beam systems are known in the art as exemplified by U.S. Pat. No. 3,760,225 issued Sept. 18, 1973 and No. 3,846,668 issued Nov. 5, 1974, each in the name of K. W. Ehlers et al.

High energy neutral beams are an essential element for fueling and heating the plasma in controlled fusion devices. Present development in neutral beam technology calls for high current ion generation as the first step in the production of these neutral beams. Subsequent neutralization of these accelerated ions results in the desired neutral beam. Report LBL-4471, June 1976, by K. W. Ehlers et al, exemplifies prior known high energy neutral-beam injection systems. Neutral beam modules have provided fuel and plasma heating for both Magnetic Mirror and Tokamak plasmas as exemplified by the 2XIIB Mirror at Lawrence Livermore Laboratory and the PLT Tokamak at Princton, the resulting plasmas have generated neutrons, alpha particles, and other forms of useful energy. The Mirror Fusion Test Facility (MFTF) described in report UCRL-80700, June 1978, entitled "Mirror Fusion Test Facility Design and Construction", for example, will employ forty-eight neutral beam sources. Because of the large number of units required and the limited mounting space available, it is essential that the individual neutral beam modules be as small as possible. Thus, the neutral beam modules for the MFTF, for example, must provide a compact and maintainable source of 80-keV neutral beams that focus to a high power density, while maintaining high voltage integrity by reducing the spacing which could lead to long-path breakdown.

SUMMARY OF THE INVENTION

The present invention provides a maintainable, compact 80-keV arc-chamber-extractor module for a neutral beam module having the ion source and ion accelerator sections in a vacuum (low pressure environment less than 1 Torr) and utilizing a 60-keV gradient shield for reducing long-path breakdown while being constructed such that the ion source or arc chamber can be removed by itself and the ion accelerator or extractor can be removed either after the arc chamber or while still carrying the arc chamber. Such provides for each refilamenting of the arc chamber, considered to be the most frequent maintenance job. Immersion of the arc chamber and extractor in a vacuum establishes a breakdown voltage gradient that is about 2.5 times that of sulfur hexafluoride $SF_6$ and about 6 times that of air, both being at one atmosphere pressure. An additional safety factor of as much as 6 is achieved against long-path breakdown due to the 60-keV gradient or corona shield which completely encloses the 80-keV electrode from the surrounding ground potential.

Therefore, it is an object of the present invention to provide a compact, maintainable 80-Kev arc chamber, extractor, neutral beam module.

A further object of the invention is to provide a neutral beam module having an arc chamber removably mounted within an extractor such that both the arc chamber and extractor are immersed in a vacuum and readily removable.

Another object of the invention is to provide an 80-keV neutral beam module having a 60-keV gradient shield surrounding at least the arc chamber for reducing long-path breakdown along electric field lines.

Another object of the invention is to provide a neutral beam module wherein the arc chamber is either readily removable from the extractor or with the extractor for maintenance purposes.

Other objects of the invention, not specifically set forth above, are deemed readily apparent from the following description and accompanying drawings.

DETAILED DESCRIPTION OF THE INVENTION

The invention is a readily maintainable, compact 80-keV neutral beam module consisting basically of an ion source and an ion accelerator immersed in a vacuum of $<10^{-2}$ Torr, incorporating a nested 60-keV gradient shield, and constructed such that the ion source can be removed by itself for maintenance and the ion accelerator can be removed from the associated system either after removal of the ion source or while still carrying the ion source. The 60-keV gradient shield is located midway between the high voltage ion source and surrounding grounded frame. This shield reduces breakdown or arcing path length without increasing the voltage gradient, tends to keep electric fields normal to conducting surfaces rather than skewed and reduces the peak electric field around irregularities on the 80-keV electrodes. The mounting of the ion source separate from the ion accelerator reduces misalignment of the accelerator as well as permitting separate maintenance. By immersing the module in a vacuum, the voltage can be held over shorter distances than in air; such was found preferred over surrounding the source with sulfur hexafluoride $SF_6$ because the latter would involve an extra set of feedthroughs: from air to $SF_6$ and from $SF_6$ to vacuum, and instead go directly from air to vacuum. The size of the module (ion source and ion accelerator) of the present invention is reduced by mounting the module in vacuum where the breakdown voltage gradient is about 2.5 times that of $SF_6$ and about 6 times that of air, both being at one atmosphere pressure. An additional advantage of the present invention is that rectangular high voltage insulators are no longer used as vacuum walls. Cylindrical feedthrough insulators are used, such insulators being cheaper and more reliable.

Figure 1:
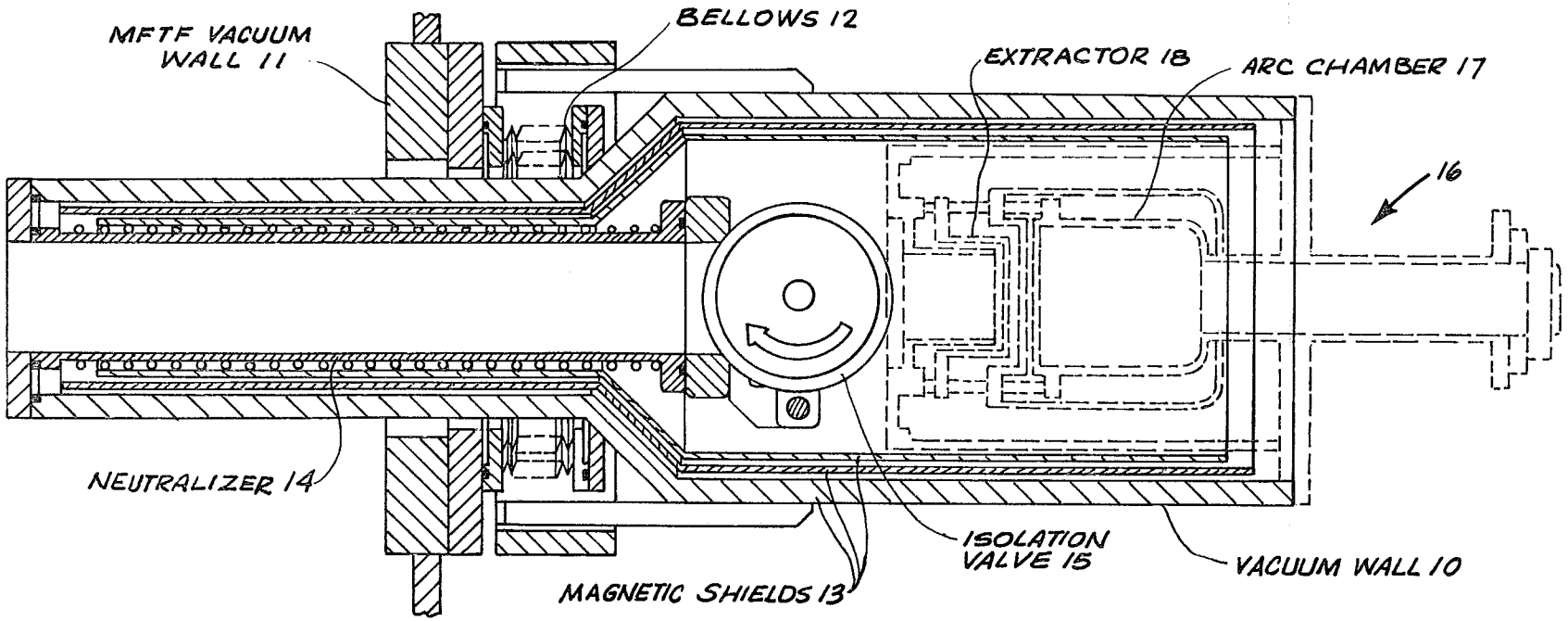
FIG. 1 is a cross-sectional view of an overall MFTF neutral beam module including a neutralizer, isolation valve, and magnetic shields with the compact arc chamber and extractor module of the present invention illustrated in phantom.

FIG. 1 illustrates an overall MFTF neutral beam module incorporating the 80-keV maintainable, compact module of the present invention. The overall module basically consists of a housing defining a vacuum wall 10 mounted in an MFTF vacuum wall 11 via a bellows mechanism 12, with magnetic shields 13, neutralizer 14, and isolation valve 15 mounted within the vacuum wall. The compact module of this invention, generally indicated at 16 and shown in phantom, is positioned within one end of and removably secured to vacuum wall 10. The compact module 16 basically consists of an arc chamber or ion source 17 and an extractor or ion accelerator 18, illustrated in detail in FIG. 2. The module 16 is immersed in a vacuum ($<10^{-2}$ Torr in this embodiment) to provide compactness, since as pointed out above, in a vacuum the voltage can be held over shorter distances than in air. The details of the components of basic MFTF module of FIG. 1, except for module 16, do not constitute part of the present invention and are known in the art, as evidenced by report UCRL-79682 by A. W. Molvik et al included in the Proceedings of the Seventh Symposium on Engineering Problems of Fusion Research, Knoxville, Tenn., Oct. 25-28, 1977. Accordingly, further description of the components of FIG. 1, except for the compact module 16, need not be provided herein, but have been illustrated to clearly establish the relationship of the invention to such an overall MFTF module.

The present invention, illustrated in FIG. 2 and described hereinafter in detail, represents a significant improvement in the reliability of voltage holding over the prior known neutral beam module which is generally similar to that described in above-referenced report LBL-4471. The 60-keV gradient shield of the FIG. 2 embodiment completely encloses the 80-keV electrode from the surrounding ground potential. This shield reduces the peak electric field at irregularities on the 80-keV electrode surface and distributes the electric field more uniformly along the support insulators. In addition, Paschen (long path) breakdown is suppressed by reducing the separation between high voltage electrodes. The spacing between electrodes and shield must be small to prevent Paschen breakdown in the gas, but not so small that the breakdown electric field on the electrode surface is exceeded. The shields force the electric fields to be nearly normal to conducting surfaces, thus preventing Paschen breakdown following a skewed path between remote regions of the enclosure. While voltage breakdown can be reduced by reducing the voltage gradient, i.e., increasing electrode separation, at pressures $\sim 10^{-6}$ Torr, Paschen breakdown is reduced at pressures $\sim 10^{-2}$ Torr by decreasing the spacing between two electrodes. The gradient shield satisfies these contradictory requirements by separating the 80-keV to ground gap into two gaps. Since the voltage gradient is not increased, vacuum breakdown is not increased. The separation is reduced by a factor of two to $\lesssim 9$ cm, hence the pressure may rise to the ion source pressure of $10^{-2}$ Torr while maintaining a safety factor of $>2$ from Paschen breakdown, as shown in FIG. 3 which graphically illustrates the left-hand sections of the Paschen curve for different gases. The gradient shield thus makes possible the mounting of the ion source of arc chamber separately from the extractor or accelerator grids without requiring a gas seal between them.

Figure 2:
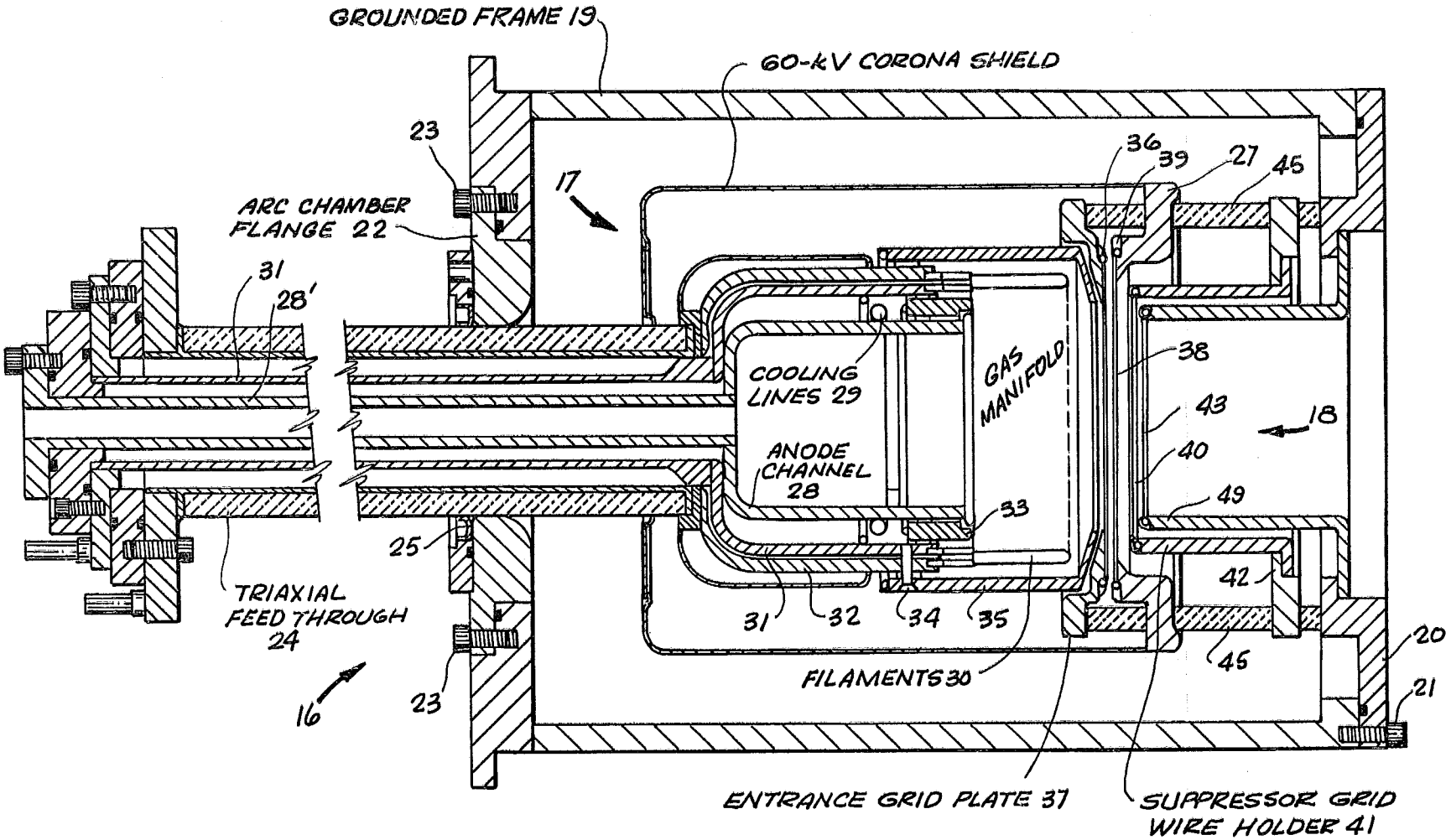
FIG. 2 is a cross-sectional view of a compact 80-keV module in accordance with the invention.
Figure 3:
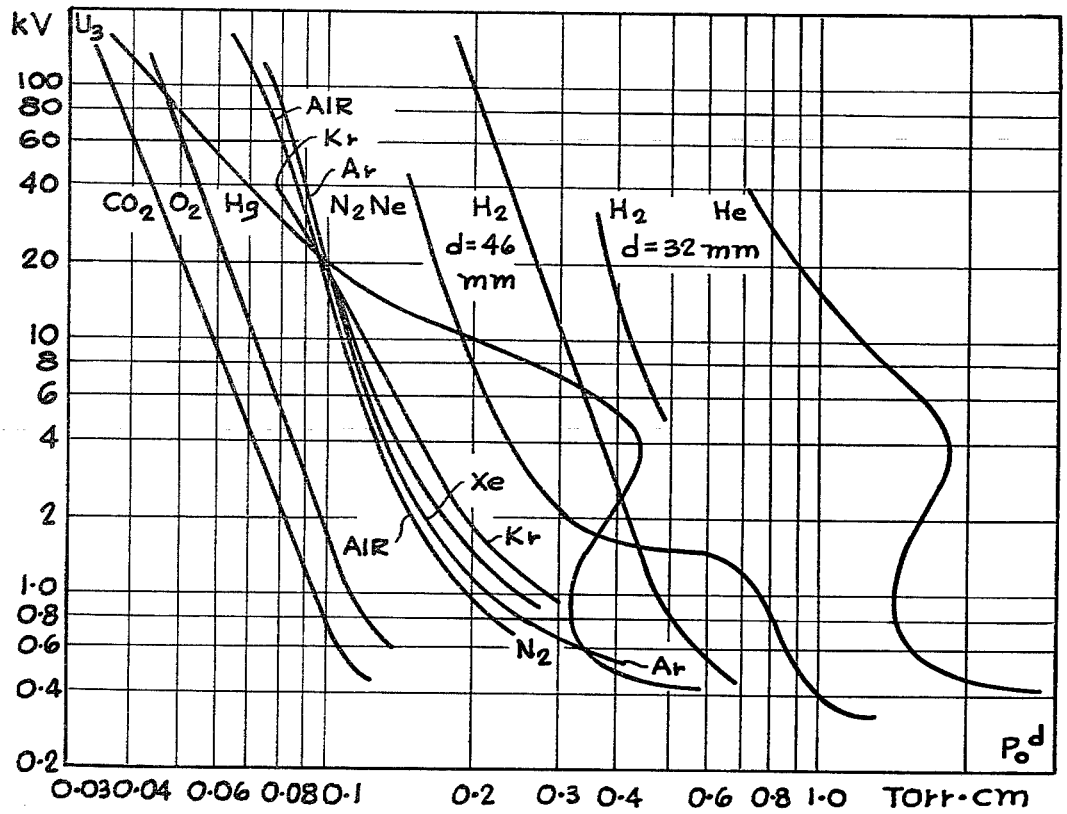
FIG. 3 graphically illustrates the left-hand sections of the Paschen curve for different gases which establish the long path limit for high voltage breakdown.

Mounting the ion source separately from the accelerator grids, as shown in FIG. 2, is desirable for the following two reasons: (1) to avoid cantilevering the ion source, weighing more than 100 lbs, from the acceleration grids which must maintain precise alignment to within 0.004 in., and (2) to permit maintenance of the plasma or ion source without removing the accelerator structure. In order to achieve these advantages without requiring precise alignment tolerances or elastomer gaskets between the ion source and ion accelerator, a certain amount of gas leakage is permitted. Therefore, a pressure of up to $10^{-2}$ Torr (the ion source discharge chamber pressure) may exist throughout the high voltage region. By immersing the ion source in a vacuum where a high voltage can be held over smaller distances and by redesigning accelerator grid supporting structures, the module can be more compact while providing ready maintenance features. Refilamenting the ion source or arc chamber will be the most frequent maintenance job and thus removal of the ion source by itself greatly facilitates maintenance of the module.

Referring now to FIG. 2, the ion source or arc chamber 17 is supported on ion accelerator or extractor 18 which is mounted in a grounded frame 19 via an insulator member 20 and bolts 21. A grounded, ferromagnetic, arc chamber flange 22 is secured within the grounded frame 19 via bolts 23 through which a triaxial feedthrough 24 of arc chamber 17 extends. Flange 22 is provided with a seal 25 which prevents leakage about feedthrough 24. A 60-keV corona or gradient shield 26 extends around arc chamber 17 and is secured at the lower end thereof to an insulator member 27 of extractor 18.

Arc chamber or ion source 17 consists of a centrally located, cup-shaped anode channel 28 having a gas manifold secured thereto at the open end thereof, surrounded by cooling lines 29, and having an electrical connector 28' extending through feedthrough 24. A plurality of U-shaped filaments 30 are connected at opposite ends to support members 31 and 32, support member 31 extending through feedthrough 24 with support member 32 being secured to the lower end of feedthrough 24. The anode channel 28 is maintained in fixed relation with respect to filaments 30 by an insulator member 33. Filament support members 31 and 32 are secured by pins 34 to an insulated support sleeve 35 which is itself secured at the opposite end from the pins 34 to the extractor 18 through a dish-like member having an annular opening. While not shown, the anode 28 and filaments 30 are electrically connected to appropriate power supplies as known in the art, with cooling lines 29 operatively connected to a coolant source. The upper ends of feedthrough 24, electrical connector 28', and support member 31 are secured together and electrically insulated from one another as shown.

The extractor or ion accelerator 18, similar to that described in above-referenced report LBL-4471, utilizes four (4) grids each connected to an appropriate power supply, not shown. These grids consist of a source or entrance grid 36 mounted on an entrance grid plate 37, a gradient grid 38 mounted on a gradient grid plate 39 which is secured to insulator member 27, suppressor grid 40 secured to a suppressor grid wire holder 41 mounted on an insulator member 42, and an exit grid 43 secured to an exit grid wire holder 44 mounted on insulator 20. Each of insulator 20, insulator members 42 and 27 and entrance grid plate 37 are threadedly secured to threaded members 45 whereby each of the grids 36, 38, 40 and 43 can be adjustably positioned with respect to an adjacent grid.

The arc chamber pressure of $P \sim 10^{-2}$ Torr of $D_2$ is expected to fill most of the high electric field regions of the FIG. 2 embodiment. Breakdown at 80-KeV is expected for $Pd > 0.2$ Torr·cm in hydrogen, where d is the breakdown distance between electrodes. In deuterium, we gain the square root of the mass ratio, so that breakdown occurs for $Pd > 0.3$ Torr·cm. To prevent breakdown, this invention reduces the breakdown distance along electric field lines by means of the nested 60-keV shields, which divides the distance in half and which tend to keep electric fields normal to surfaces rather than skewed. This results in path lengths of $d \lesssim 5$ cm normal to surfaces. The embodiment minimizes the magnetic field strength and reduces the possibility that a long path along magnetic field lines will connect two electrodes. Thus, a safety factor of as much as 6 is achieved against long-path breakdown.

It has thus been shown that the present invention provides a compact, readily maintainable 80-keV module composed of an ion source or arc chamber and an ion accelerator or extractor for use in a neutral beam module, such as that used in the MFTF, wherein a 60-keV gradient shield is positioned around the 80-keV electrodes and located midway between the ion source and surrounding grounded frame for reducing long-path breakdown. The module is immersed in a vacuum of $< 10^{-2}$ Torr which provides for compactness, and is constructed such that the ion source can be removed separately or with the ion accelerator from the overall neutral beam module to provide for ready maintenance of either the ion source or the ion accelerator.

While a particular embodiment of the invention has been illustrated and described, modifications will become apparent to those skilled in the art, and it is intended to cover in the appended claims all such modifications as come within the spirit and scope of the invention.

What is claimed is:

1. In a neutral beam module comprising at least an ion source, an ion accelerator, an isolation valve, and a neutralizer positioned within a housing defining a vacuum wall and having at least one magnetic shield positioned in and adjacent said housing, the improvement comprising: an electrically grounded frame removably secured within one end of said housing, said ion accelerator and said ion source being aligned with one another and with each being removably mounted within said grounded frame, and means located within said grounded frame for reducing long-path breakdown, said means including at least one gradient shield means surrouding at least said ion source and positioned substantially midway between said ion source and said grounded frame, said ion source and said ion accelerator being immersed in a vacuum.

2. The improvement defined in claim 1, wherein said module is of an 80-keV type and said gradient shield is of a 60-keV type.

3. The improvement defined in claim 1, additionally including an electrically grounded flange removably mounted in said grounded frame such that removal of said grounded flange allows said ion source to be removed from within said grounded housing without removing said ion accelerator.

4. The improvement defined in claim 3, wherein said ion source comprises at least a centrally located anode means and a plurality of filament means positioned in spaced relation with respect to said anode means, and a feedthrough means providing for electrical connection to said anode means and said filament means, said feedthrough means extending through said grounded flange.

5. The improvement defined in claim 4, wherein said anode means is of a cup-shaped configuration having an opening in the direction of said ion accelerator, and wherein said filament means are supported in spaced relation with respect to said anode means by a plurality of support members.

6. The improvement defined in claim 5, additionally including cooling lines surrounding said cup-shaped anode means, and having a gas manifold positioned in said cup-shaped anode means adjacent said opening therein.

7. The improvement defined in claim 4 or 6 additionally including a sleeve means secured at one end to said support members and adapted to abut said ion accelerator at the other end thereof.

8. In a neutral beam module comprising at least an ion source, an ion accelerator, an isolation valve, and a neutralizer positioned within a housing defining a vacuum wall and having at least one magnetic shield positioned in and adjacent said housing, the improvement comprising: an electrically grounded frame removably secured within one end of said housing and having said ion accelerator and said ion source aligned with one another with each being removably mounted within said grounded frame, and at least one gradient shield means surrounding at least said ion source and positioned substantially midway between said ion source and said grounded frame for reducing long-path breakdown, said ion source and said ion accelerator being immersed in a vacuum, said ion accelerator being provided with a plurality of grids and grid support means, said grid support means being adjustably secured to a threaded member via a plurality of electrical insulation means, said threaded member being secured to said grounded frame via electrical insulation means.

9. The improvement defined in claim 8, wherein said gradient shield means is operatively connected to said ion accelerator via one of said plurality of electrical insulation means.

* * * * *